US011579555B2

(12) United States Patent
Yoshioka et al.

(10) Patent No.: US 11,579,555 B2
(45) Date of Patent: Feb. 14, 2023

(54) CYLINDER MEMBER AND IMAGE FORMING APPARATUS

(71) Applicant: FUJIFILM Business Innovation Corp., Tokyo (JP)

(72) Inventors: Tomoaki Yoshioka, Kanagawa (JP); Kazuki Kishi, Kanagawa (JP); Kazuyoshi Hagiwara, Kanagawa (JP); Yoko Miyamoto, Kanagawa (JP); Toshiaki Baba, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/319,609

(22) Filed: May 13, 2021

(65) Prior Publication Data

US 2022/0082979 A1 Mar. 17, 2022

(30) Foreign Application Priority Data

Sep. 15, 2020 (JP) ..... JP2020-154640

(51) Int. Cl.
*B65H 1/08* (2006.01)
*G03G 15/00* (2006.01)
*B65H 5/08* (2006.01)

(52) U.S. Cl.
CPC ..... *G03G 15/6529* (2013.01); *B65H 5/085* (2013.01)

(58) Field of Classification Search
CPC .... B65H 5/085; G03G 15/6529; B41N 10/06; B41F 30/04
See application file for complete search history.

(56) References Cited

U.S. PATENT DOCUMENTS 3,994,224 A * 11/1976 Hill ..... B41F 27/14 101/415.1
4,006,686 A * 2/1977 Ackerman ..... B41F 27/1231 101/415.1
4,688,483 A * 8/1987 Schollenberger ..... B41L 29/14 101/415.1
5,042,384 A * 8/1991 DeMoore ..... B41F 22/00 101/483
5,088,404 A * 2/1992 MacConnell ..... B41F 22/00 101/409
5,272,978 A * 12/1993 Wehle ..... B41F 30/04 101/409
5,979,322 A * 11/1999 DeMoore ..... B41F 30/04 101/493

FOREIGN PATENT DOCUMENTS

JP 58-5769 A 1/1983
WO WO-2013171894 A1 * 11/2013 ..... B41F 13/193

* cited by examiner

*Primary Examiner* — Jennifer Bahls
(74) *Attorney, Agent, or Firm* — Sughrue Mion, PLLC

(57) ABSTRACT

A cylinder member includes: a cylinder body having a cylindrical shape; a sheet member wound on the cylinder body; a first attachment portion provided at one end portion of the sheet member in a circumferential direction, the first attachment portion being detachably attached to the cylinder body; and a second attachment portion provided at the other end portion of the sheet member in the circumferential direction, the second attachment portion being detachably attached to the cylinder body.

18 Claims, 13 Drawing Sheets

CYLINDER MEMBER AND IMAGE FORMING APPARATUS

CROSS-REFERENCE TO RELATED APPLICATIONS

This application is based on and claims priority under 35 USC 119 from Japanese Patent Application No. 2020-154640 filed Sep. 15, 2020.

BACKGROUND

(i) Technical Field

The present disclosure relates to a cylinder member and an image forming apparatus.

(ii) Related Art

JP-A-58-005769 discloses a transfer device for transferring an image on an image carrier. The transfer device includes a transferred, material transporting unit, a gripper piece, and a switch member. The transferred material transporting unit, moves a transferred material in an endless manner along a circulating movement path. The gripper piece is attached to the transporting unit. The gripper piece is pivotally supported by a rotating shaft. The gripper piece rotates relative to a base member. The gripper piece holds a leading end side of the transferred material. The switch member is attached to a base member side. In order to detect whether the transferred material is in the gripper, a part of a switch, member position in the gripper piece is cut out.

SUMMARY

A cylinder member includes a cylinder body having a cylindrical shape, and a sheet member wound on the cylinder body. One end portion and the other end portion of the sheet member in a circumferential direction and one end portion and the other end portion of the sheet member in a width direction are detachably attached to the cylinder body. In this configuration, replacement of the sheet member requires detaching the one end portion, and the other end portion of the sheet member in the circumferential direction and the one end portion and the other end portion of the sheet member in the width direction from the cylinder body. So, the replacement of the sheet member is complicated.

Aspects of non-limiting embodiments of the present disclosure relate to facilitating replacement of a sheet member as compared to a configuration in which one end portion and the other end portion of a sheet member in a circumferential direction, and one end portion and the other end portion of the sheet member in a width direction are detachably attached to the cylinder body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cylinder member including: a cylinder body having a cylindrical shape; a sheet member wound on the cylinder body; a first attachment portion, provided at one end portion of the sheet member in a circumferential direction, the first attachment portion being detachably attached to the cylinder body; and a second attachment portion provided at the other end portion of the sheet member in the circumferential direction, the second attachment portion being detachably attached to the cylinder body.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments according to the present disclosure will be described with reference to the accompanying drawings.

First Exemplary Embodiment

Image Forming Apparatus 10

Figure 1:
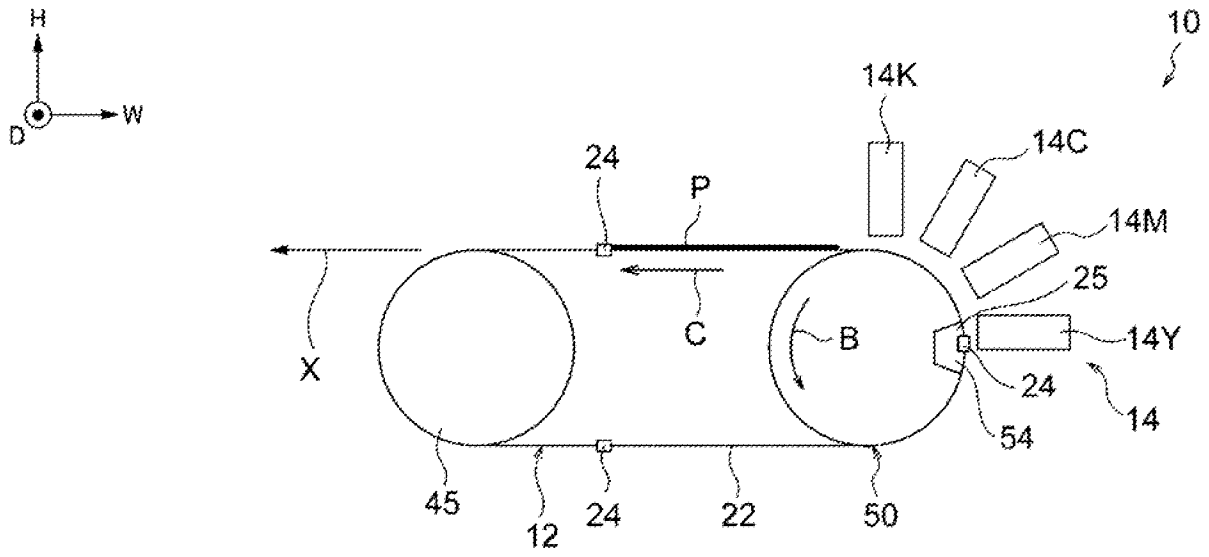
FIG. 1 is a schematic diagram showing a configuration, of an image forming apparatus according to a first exemplary embodiment.

First, a configuration of the image forming apparatus 10 according to the first exemplary embodiment will be described. FIG. 1 is a schematic diagram showing the configuration of the image forming apparatus 10 according to the present exemplary embodiment. As shown in the drawings, an arrow H indicates an apparatus height direction which is a vertical direction, an arrow W indicates an apparatus width direction which is one of horizontal directions, and an arrow D indicates an apparatus depth direction which is another one of the horizontal directions (a front and rear direction of the apparatus). Dimensional ratios in the R direction, the W direction, and the D direction of respective elements shown in the respective drawings may be different from actual dimensional ratios.

The image forming apparatus 10 shown in FIG. 1 is an inkjet image forming apparatus that forms an ink image (an example of an image) on a recording medium P, Specifically, the image forming apparatus 10 includes an image forming unit 14, a transport mechanism 12, and an opposing cylinder 50. Hereinafter, each of elements (that is, the image forming unit 14, the transport mechanism 12, and the opposing cylinder 50) of the image forming apparatus 10 will be described.

Image Forming Unit 14

The image forming unit 14 has a function of forming an ink image on the transported, recording medium P. Specifically, as shown in FIG. 1, the image forming unit 14 includes ejection units 14Y, 14M, 14C, and 14K (hereinafter, referred to as 14Y to 14K) that eject ink to predetermined ejection positions.

The ejection units 14Y to 14K are disposed in the above order toward a downstream side m a transport direction of the recording medium P. The ejection units 14Y to 14K are elongated along a width direction of the recording medium P. The width direction of the recording medium P is a direction that intersects the transport direction (specifically, a direction which is perpendicular to the transport direction), and is a direction extending along the front and rear direction of the apparatus.

Then, in the image forming unit 14, the ejection units 14Y to 14K eject, ink droplets onto the recording medium. P, which is transported by the transport mechanism 12, using a known technique such as a thermal technique or a piezoelectric technique to form the ink image on the recording medium P.

Transport Mechanism 12

Figure 2:
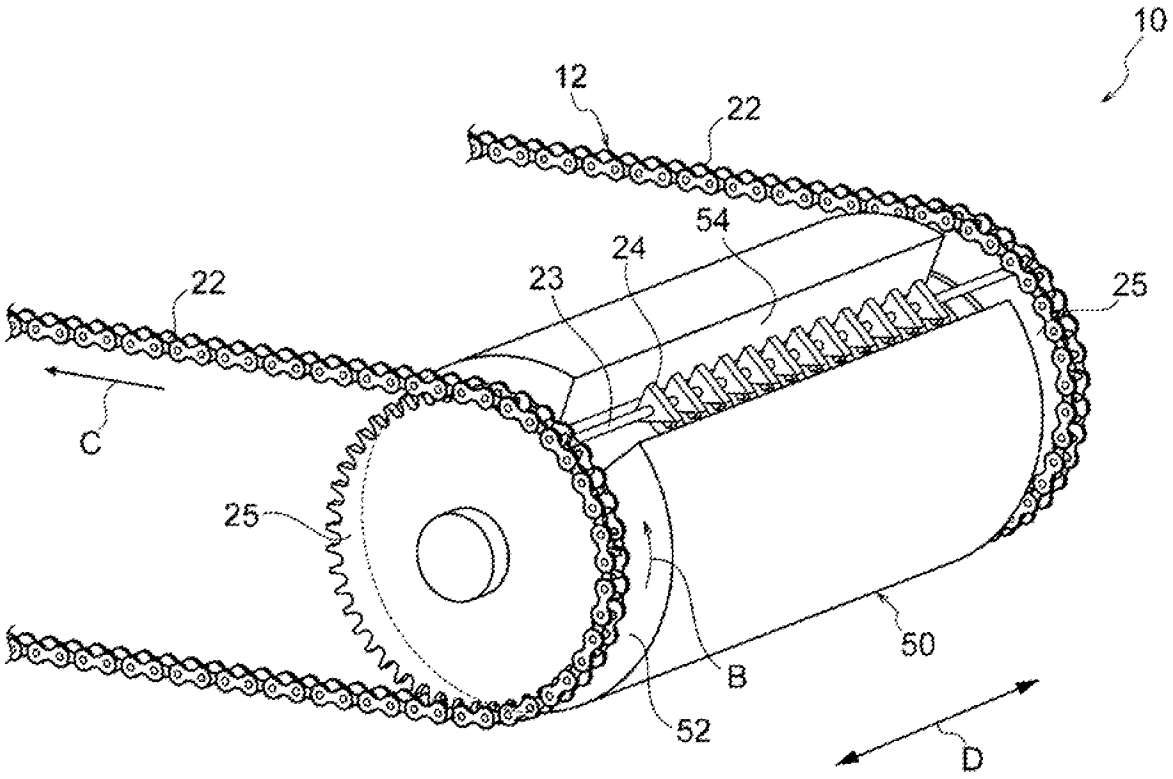
FIG. 2 is a perspective view showing a configuration around an opposing cylinder according to the first exemplary embodiment.

The transport mechanism 12 shown in FIG. 1 is a mechanism that transports the recording medium P. As shown in FIGS. 1 and 2, the transport mechanism 12 includes a pair of chains 22, and grippers 24. In FIG. 1, one of the chains 22 is shown, and the chain 22 and the grippers 24 are shown in a simplified manner.

As shown in FIG. 1, each of the chains 22 is formed in an annular shape. As shown in FIG. 2, the chains 22 are arranged at an interval in the apparatus depth direction (that is a D direction in FIG. 2). Each of the chains 22 is wound on a respective one of sprockets 25 and a respective one of sprockets 45 (see FIG. 1). The sprockets 25 are provided on both end sides, in an axial direction, of the opposing cylinder 50. The opposing cylinder 50 and the pair of sprockets 25 are integrally rotationally driven in a rotation direction B (a direction of the arrow B), and thereby the chain 22 circulates in a circulating direction C (a direction of the arrow C).

As shown in FIG. 2, an attachment member 23 to which grippers 24 are attached is bridges between the chains 2:2 along the apparatus depth direction. The plural attachment members 23 are fixed to the pair of chains 22 at predetermined intervals along the circulating direction C of the chains 22.

Figure 3:
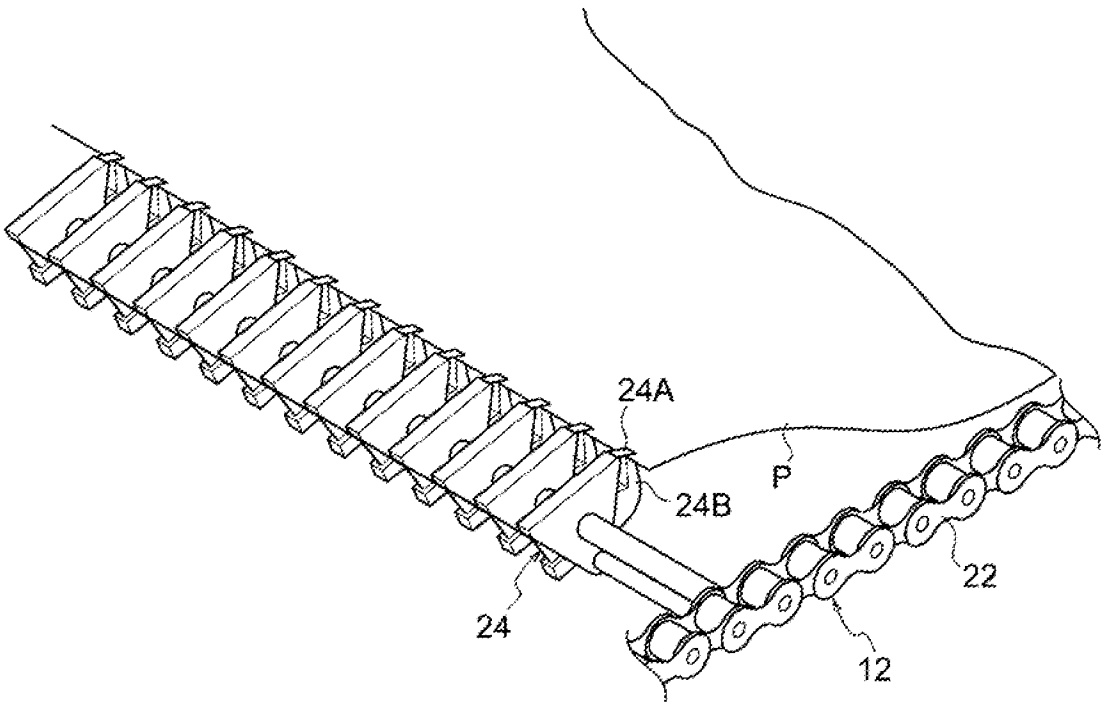
FIG. 3 is a perspective view showing a gripper according to the first exemplary embodiment.

As shown in FIGS. 2 and 3, the plural grippers 24 are attached to the attachment member 23 at predetermined intervals along the apparatus depth direction. The gripper 24 functions as a holder that holds a leading end portion of the recording medium P. Specifically, as shown in FIG. 3, the gripper 24 includes a pawl 24A and a pawl base 24B. The gripper 24 holds the recording medium P by sandwiching the leading end portion of the recording medium P between the pawl 24A and the pawl base 24B, In the gripper 24, for example, the pawl 24A is pressed against the pawl base 24B by a spring, and the pawl 24A is opened from and closed to the pawl base 24B by the action of a cam.

In the transport mechanism 12, as shown in FIG. 3, the grippers 24 hold the leading end portion of the recording medium P sent from an accommodating unit. (not illustrated) that accommodates recording media P. The gripper 24 that is holding the leading end portion of the recording medium P is located in a recess 54 formed on an outer periphery of the opposing cylinder 50, and the recording medium P is placed on the outer peripheral surface of the opposing cylinder 50 (specifically, an outer peripheral surface of a sheet member 60 which will be described later). Then, when the opposing cylinder 50 are rotationally driven in the rotation direction B and the chains 22 circulate in the circulating direction C, the grippers 24 and the opposing cylinder 50 rotate together, and the recording medium P, which is placed on the outer peripheral surfaces of the opposing cylinder 50 and whose leading end portion is held by the grippers 24, is transported to the ejection positions of the ejection units 14Y to 14K. The recording medium P is transported in a state of being placed on the enter peripheral surface of the sheet member 60 (which will be described later) of the opposing cylinder 50 so as to pass through the ejection, positions while maintaining a smooth state.

Opposing Cylinder 50

Figure 4:
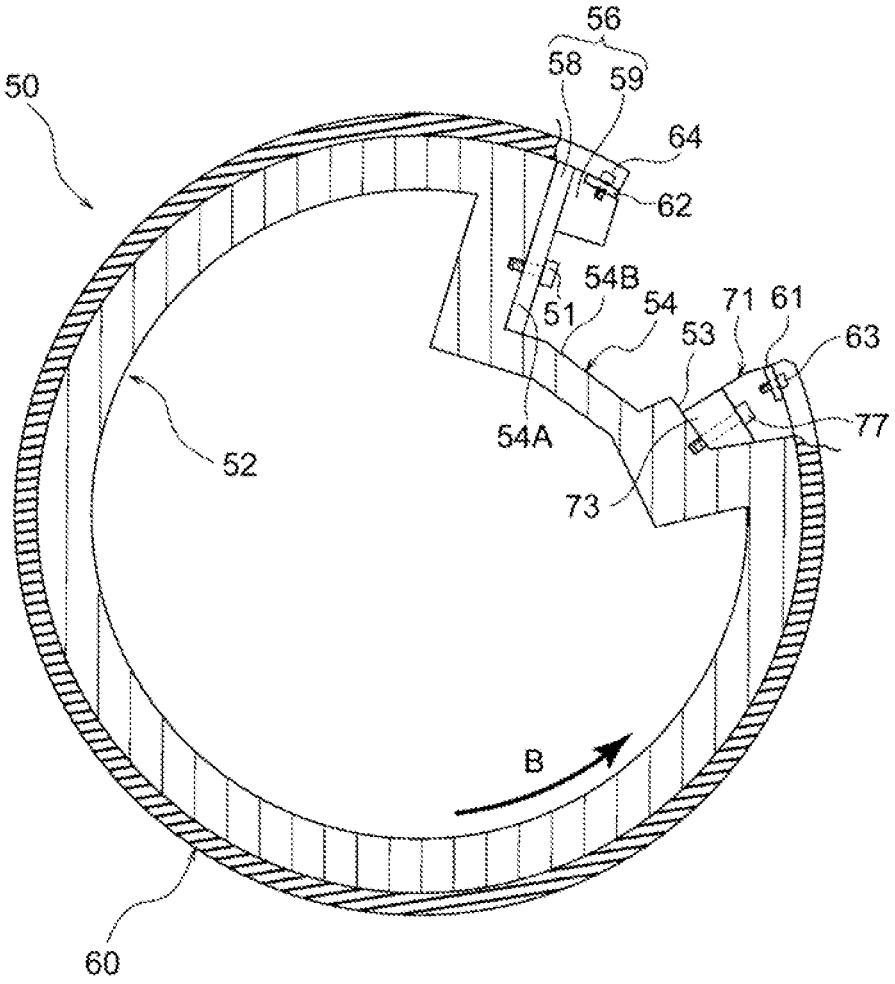
FIG. 4 is a side cross-sectional view showing the opposing cylinder according to the first exemplary embodiment.

As shown in FIG. 1, the opposing cylinder 50 is a cylinder member opposing the ejection units 14Y to 14K. Specifically, as shown in FIG. 4, the opposing cylinder 50 has an opposing cylinder body 52 (an example of a cylinder body), a sheet member 60 wound on the opposing cylinder body 52, a first attachment member 61 (an example of a first attachment, portion), and a second attachment member 62 (an example of a second attachment portion). In FIGS. 1 and 2, the opposing cylinder 50 is shown, in a simplified manner.

As shown in FIG. 4, the opposing cylinder body 52 is formed in a cylindrical shape. A single recess 54 is formed in a part of the opposing cylinder 52 in a circumferential direction thereof. The recess 54 is formed along the axial direction. The recess 54 has a depth along a radial direction of the opposing cylinder body 52. The opposing cylinder body 52 is made of a metal material such as stainless steel or aluminum. Hereinafter, the axial direction of the opposing cylinder body 52 (that is, the axial direction of the opposing cylinder 50) may be simply referred to as an "axial direction". The radial direction of the opposing cylinder body 52 (that is, the radial direction of the opposing cylinder 50) may be simply referred to as a "radial direction". The circumferential direction of the opposing cylinder body 52 (that is, the circumferential direction of the opposing cylinder 50) may be simply referred to as a "circumferential direction". An upstream side in the rotation direction of the opposing cylinder 50 may be simply referred to as "upstream", and a downstream side in the rotation direction of the opposing cylinder 50 may be simply referred to as "downstream".

As shown in FIG. 2, the sprockets 25 described above are provided on both end sides, in the axial direction, of the opposing cylinder body 32. The sprockets 25 are disposed coaxially with the opposing cylinder body 52, and rotate integrally with the opposing cylinder body 52.

As shown in FIG. 4, the sheet member 60 is a sheet-shaped member that is wound on the opposing cylinder body 52. Specifically, the sheet member 60 is wound on the outer peripheral surface of the opposing cylinder body 32 in a non-adhesive manner.

The term "sheet shape" ("sheet-shaped") refers to a shape of paper, a thin plate, or the like having a property of being deformable along the outer periphery of the opposing cylinder body 52. As shown in FIG. 4, a length, in the circumferential direction, of the sheet member 60 is substantially the same as a length, in the circumferential direction, of the opposing cylinder body 52 excluding the recess 54.

Specifically, the sheet member 60 includes an elastic layer. As the elastic layer, for example, a rubber layer made of foamed rubber is used. Examples of the rubber layer include nitrile rubber, chloroprene rubber, ethylene-propylene-diene methylene rubber (EPDM rubber), acrylonitrile butadiene rubber, hydrin rubber, silicone rubber, urethane rubber, and mixtures thereof. The sheet member 60 may have a surface layer on a surface thereof.

A friction coefficient between the outer peripheral surface of the opposing cylinder body 52 and the sheet member 60 may be large. As described above, the sheet member 60 is not adhered to the outer peripheral surface of the opposing cylinder body 52. If the friction coefficient between the outer peripheral surface of the opposing cylinder body 52 and the sheet member 60 is large, the sheet member 60 is less likely to be deviated from the outer peripheral surface of the opposing cylinder body 52, and lifting of the sheet member 60 from the outer peripheral surface is prevented. The friction coefficient is adjusted using, for example, a material selected as the sheet member 60 and surface processing performed on a contact surface with the outer peripheral surface of the opposing cylinder body 52.

Figure 5:
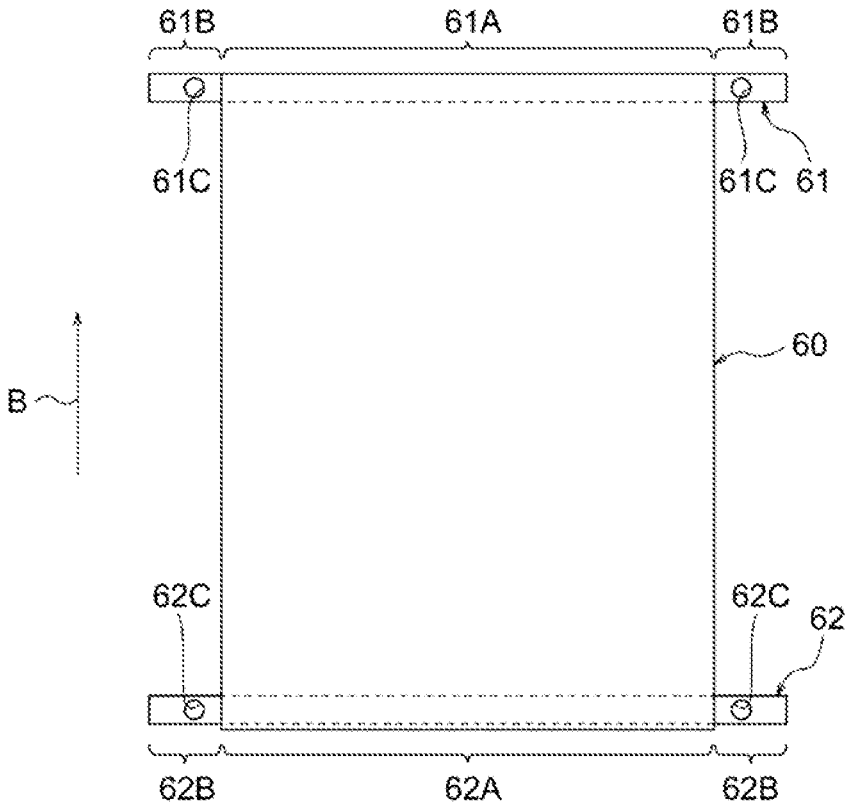
FIG. 5 is a developed view showing a sheet member according to the first exemplary embodiment.
Figure 6:
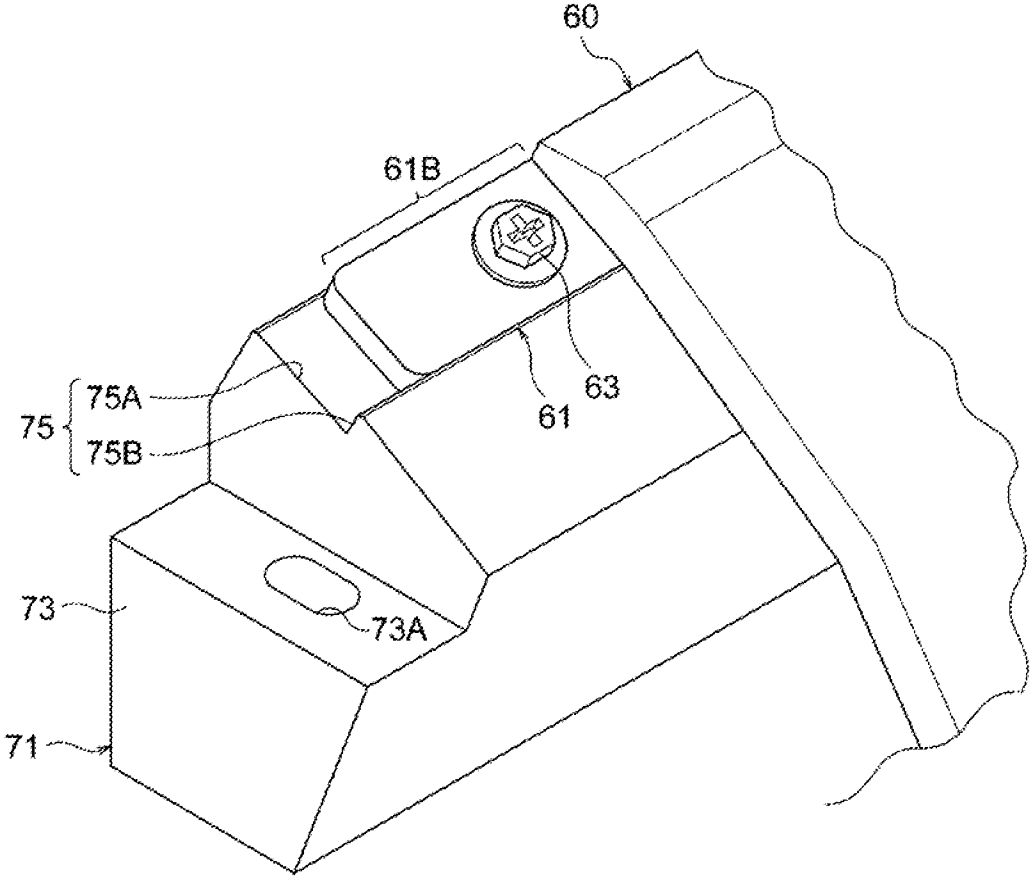
FIG. 6 is an enlarged perspective view showing a state in which one end portion, in a circumferential direction, of the sheet member according to the first exemplary embodiment is attached.
Figure 7:
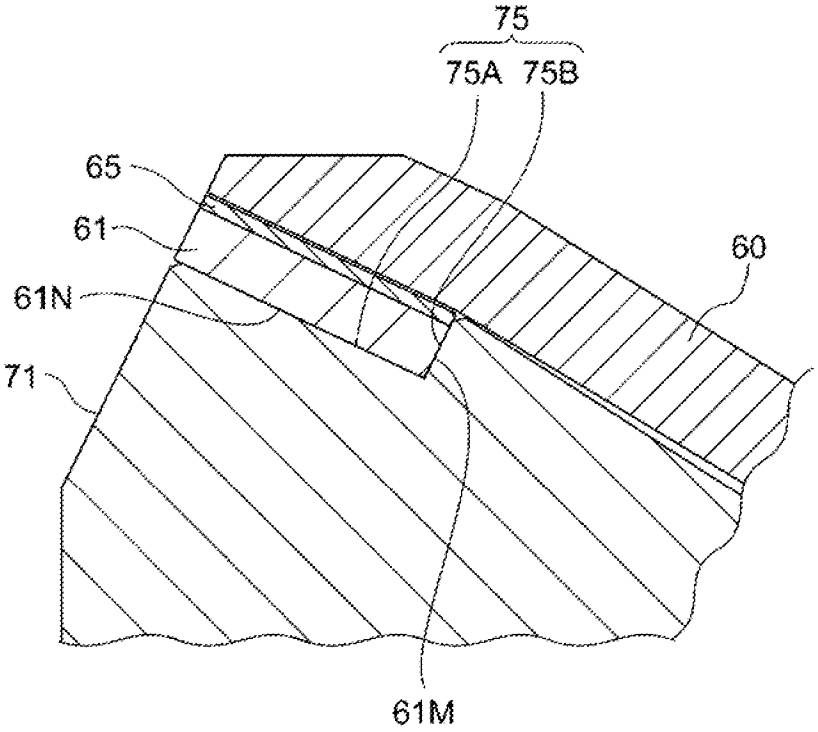
FIG. 7 is an enlarged side cross-sectional view showing the state in which the one end portion, in the circumferential direction, of the sheet member according to the first exemplary embodiment is attached.

As shown in FIGS. 4 and 5, the first attachment member 61 is provided along the axial direction and on an inner peripheral surface of the sheet member 60 at one end portion (specifically, a downstream end portion) thereof in the circumferential direction (see also FIGS. 6 and 7). The second attachment member 62 is provided along the axial direction and on the inner peripheral surface of the sheet member 60 at the other end portion (specifically, an upstream end portion) thereof in the circumferential direction (see also FIGS. 8 and 9).

The first attachment member 61 and the second attachment, member 62 are attached to the sheet member 60 using a bonding material 65 (see FIGS. 7 and 9) such as an adhesive or a double-sided tape.

As shown in FIGS. 4 to 7, each of the first attachment member 61 and the second attachment member 62 has a plate shape whose thickness direction is the radial direction, and is elongated in the axial direction. The first attachment member 61 and the second attachment member 62 are made of a metal material such as stainless steel or aluminum.

Specifically, as shown in FIG. 5, the first attachment member 61 includes a pair of protrusions 61B that protrude from the sheet member 60 toward both sides in the axial direction, and a center portion 61A disposed between the protrusions 61B. The second attachment member 62 includes a pair of protrusions 62B that protrude from the sheet member 60 toward both sides in the axial direction, and a center portion 62A disposed between the protrusions 62B.

The first attachment member 61 is disposed upstream of a downstream end of the sheet member 60. The center portion 61A is disposed within the sheet member 60 as viewed in a thickness direction of the sheet member 60 (that is, as viewed in the radial direction), hi other words, the entirety of the center portion 61A overlaps the sheet member 60 as viewed in the thickness direction of the sheet member 60 (that is, as viewed in the radial direction). In the present exemplary embodiment, the downstream end of the sheet member 60 and the downstream end of the first attachment member 61 overlap each other as viewed in the thickness direction of the sheet member 60 (as viewed in the radial direction).

Through holes 61C are formed in the protrusions 61B. Screws 63 (see FIGS. 4 and 6) are inserted through the through holes 61C. The through, holes 61C are larger than shaft portions of the screws 63. That, is, an inner diameter of the through hole 61C is larger than a shaft diameter of the shaft portion of the screw 63. Since the inner diameter of the through hole 61C is larger than the shaft diameter of the shaft portion of the screw 63, the first attachment member 61 is relatively movable in the axial direction and the circumferential direction with respect to the screw 63 inserted through the through hole 61C. The through hole 61C is smaller than a head portion of the screw 63.

The second attachment member 62 is disposed downstream of an upstream end of the sheet member 60. The center portion 62A is disposed within the sheet, member 60 as viewed in the thickness direction of the sheet member 60 (that is, as viewed in the radial direction). In other words, the entirety of the center portion 62A overlaps the sheet member 60 as viewed in the thickness direction of the sheet member 60 (as viewed in the radial direction).

Through holes 62C are formed in the protrusions 62B, Screws 64 (see FIGS. 4 and 8) are inserted through the through holes 62C. The through holes 62C are larger than shaft portions of the screws 64. That is, an inner diameter of the through hole 62C is larger than a shaft diameter of the shaft portion of the screw 64. Since the inner diameter of the through hole 62C is larger than the shaft diameter of the shaft portion, of the screw 64, the second attachment, member 62 is relatively movable in the axial direction and the circumferential direction with respect to the screw 64 inserted through the through hole 62C. The through hole 62C is smaller than a head portion of the screw 64.

As shown in FIG. 4, a stepped portion 53 is formed on one side (specifically, the upstream side), in the circumferential direction, of a bottom wall 54B in the recess 54 of the opposing cylinder body 52. The stepped portion 53 protrudes outward hi the radial direction from the bottom wall 54B. The stepped portion 53 includes an attached member 71 which is an example of an attached portion. The attached member 71 is a member to which the first attachment member 61 is attached.

The attached member 71 is formed in a substantially rectangular parallelepiped shape. The attached member 71 is elongated in the axial direction of the opposing cylinder body 52. A length of the attached member 71 along the radial direction is longer than a length of the attached member 71 along the circumferential direction. As shown in FIGS. 4 and 6, protrusions 73 are formed at radially inner portions of both axial side walls of the attached member 71. The protrusions 73 protrude outward in the axial direction.

As shown in FIG. 4, the attached member 71 is attached to the stepped portion 53 on the one side, in the circumferential direction, of the bottom wall 54B of the opposing cylinder body 52 by screwing the protrusion 73 with, a screw 77. The attached member 71 can be detached from the stepped portion 53 of the opposing cylinder body 52 by removing the screw 77, That is, the attached member 71 is detachably attached to the opposing cylinder body 52. As shown in FIG. 6, a through hole 73A is formed in the protrusion 73. The through bole 73A is a hole elongated along the circumferential direction. The screw 77 is inserted through the through hole 73A.

Then, as shown in FIGS. 4 and 6, the screws 63 inserted through the through holes 61C (see FIG. 3) of the first attachment member 61 are screwed to the attached member 71 attached to the opposing cylinder body 52. As a result, the pair of protrusions 61B is attached to the opposing cylinder body 52 via the attached member 71.

The first attachment member 61 can be detached front the attached member 71 by removing the screws 63. That is, the first attachment member 61 is detachably attached to the opposing cylinder body 52 via the attached member 71.

Further, as shown in FIGS. 6 and 7, the attached member 71 includes a positioning portion 75. The positioning portion 75 positions the one end portion (specifically, the downstream end portion) of the sheet member 60 with respect to the opposing cylinder body 52 in response to the first attachment member 61 being abutted against an upstream side of the positioning portion 75 in the circumferential direction. As shown in FIG. 7, the positioning portion 75 includes a contact surface 75A and an abutment surface 75B. The contact surface 75A contacts with a radially inner surface 61N of the first attachment member 61. The abutment surface 75B is abutted against an upstream end surface 61M of the first attachment member 61.

The inner surface 61N of the first attachment member 61 comes into contact with the contact surface 75A and the end surface 61M of the first attachment member 61 is abutted against the abutment surface 756, so that the downstream end portion of the sheet member 60 is positioned with respect to the opposing cylinder body 52.

As shown in FIG. 4, an attached member 56 (an example of the attached portion) is provided on the other side (specifically, the downstream side), in the circumferential direction, of the bottom wall 54B in the recess 54 of the opposing cylinder body 52. The attached member 56 is a member to which the other end portion (specifically, the upstream end portion) of the sheet member 60 in the circumferential direction, is attached.

Figure 8:
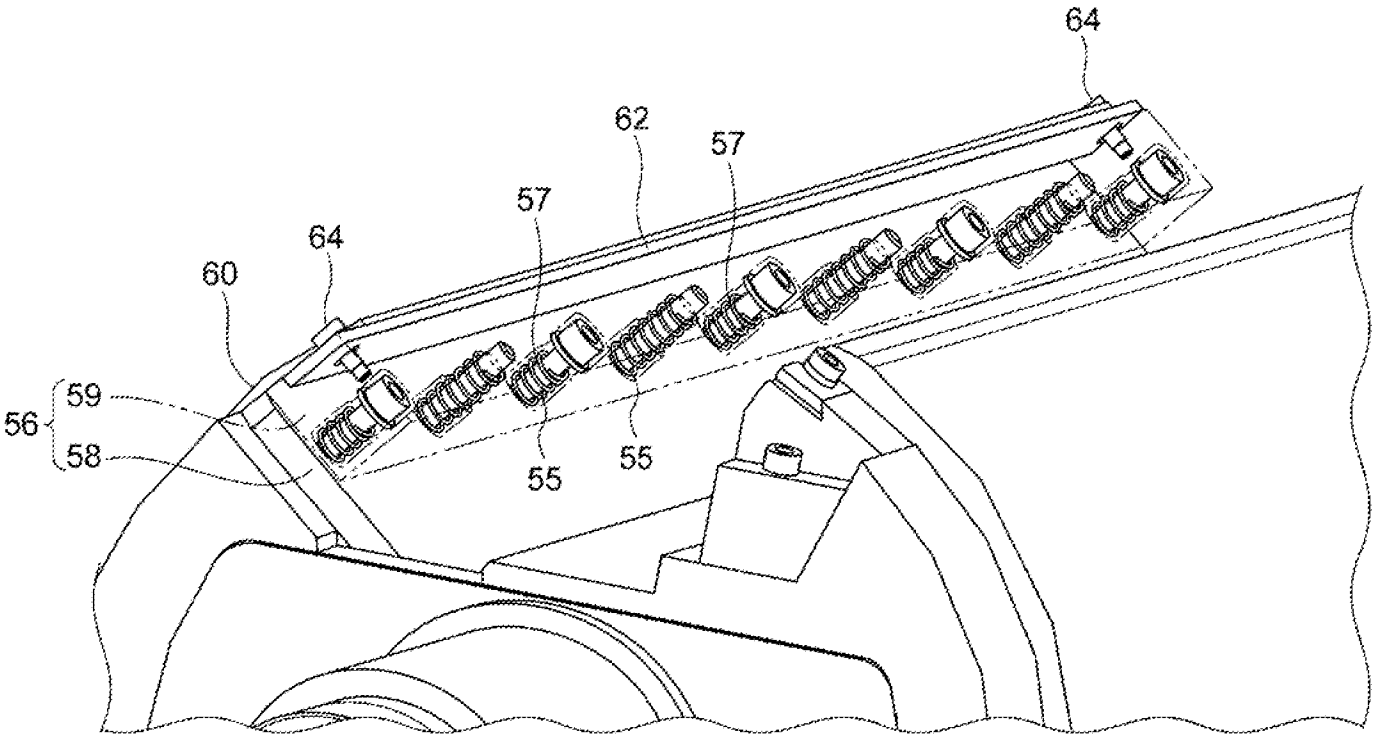
FIG. 8 is an enlarged perspective view showing a state in which the other end portion, in the circumferential direction, of the sheet member according to the first exemplary embodiment is attached.
Figure 9:
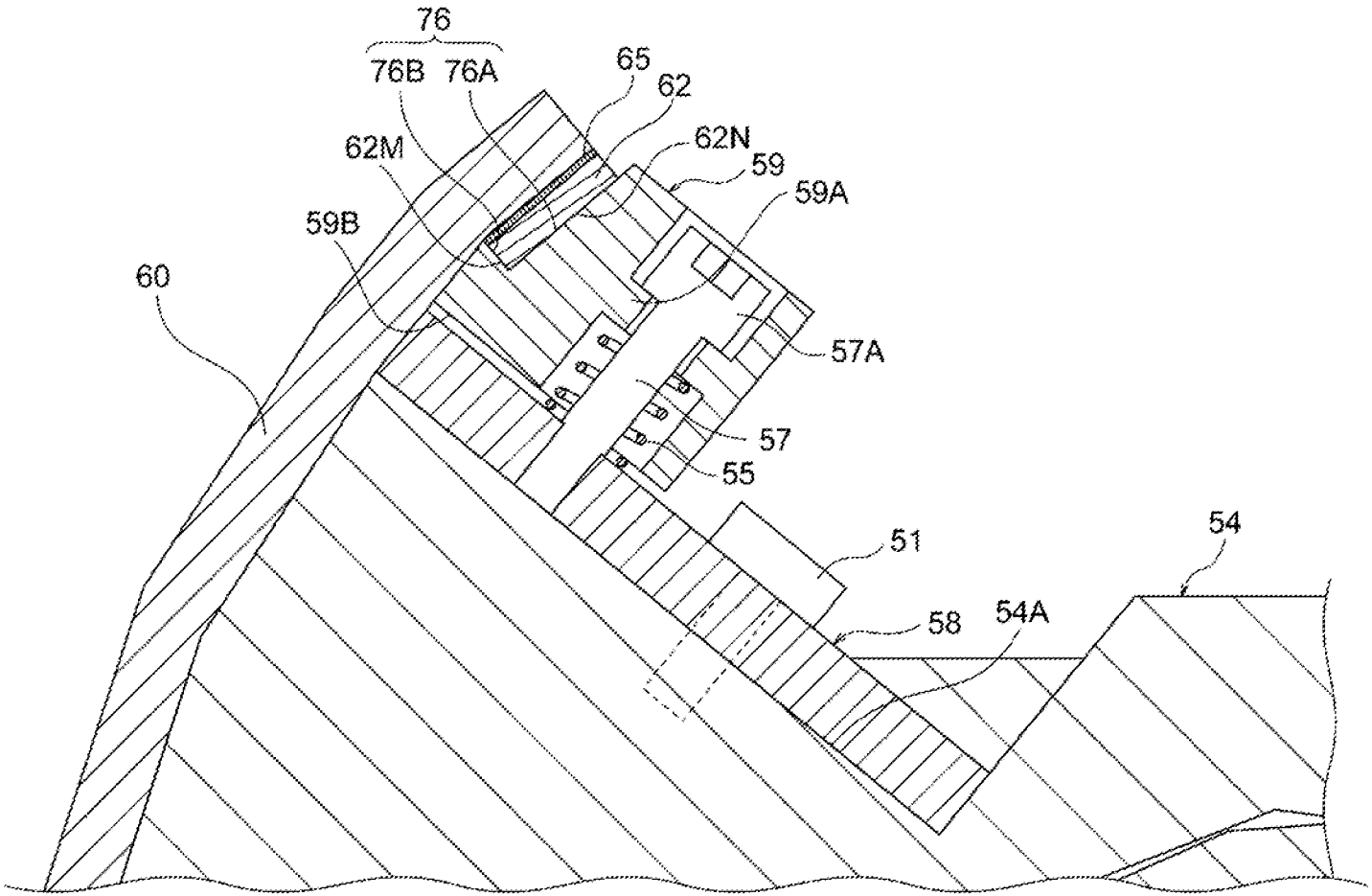
FIG. 9 is an enlarged side cross-sectional view showing the state in which the other end portion, in the circumferential direction, of the sheet member according to the first exemplary embodiment is attached.

As shown in FIGS. 4, 8, and 9, the attached member 56 includes a plate member 58 and a moving body 59 having a rectangular parallelepiped shape. The plate member 58 is elongated in the axial direction of the opposing cylinder body 52, and is formed in a plate shape whose thickness direction is the circumferential direction. The moving body 59 is formed in a rectangular parallelepiped shape and Is elongated in the axial direction of the opposing cylinder body 52.

In the attached member 56, the plate member 58 is screwed with a screw 51, so that the attached member 56 is attached to a downstream side wall 54A in the recess 54 of the opposing cylinder body 52. The attached member 56 can be detached from the side wall 54A of the opposing cylinder body 52 by removing the screw 51, That is, the attached member 56 is detachably attached to the opposing cylinder body 52.

Then, as shown in FIGS. 4 and 8, the screws 64 inserted, through the through holes 62C (see FIG. 5) of the second attachment member 62 are screwed to the moving body 59 of the attached member 56 attached to the opposing cylinder body 52. As a result, the pair of protrusions 62B is attached to the opposing cylinder body 52 via the attached member 56.

The second attachment member 62 can be detached from the attached member 56 by removing the screws 64. That is, the second attachment member 62 is detachably attached to the opposing cylinder body 52 via the attached member 56.

Further, as shown in FIG. 9, the attached member 56 includes a positioning portion 76. The positioning portion. 76 positions the other end portion (specifically, the upstream end portion) of the sheet member 60 with respect to the opposing cylinder body 52 in response to the second attachment member 62 is abutted against a downstream side of the positioning portion 76 in the circumferential direction. The positioning portion 76 includes a contact surface 76A and an abutment surface 76B. The contact, surface 76A contacts with a radially inner surface 62N of the second attachment member 62. The abutment surface 76B is abutted against a downstream end surface 62M of the second, attachment member 62.

The inner surface 62N of the second attachment member 62 comes into contact with the contact surface 76A and the end surface 62M of the second attachment member 62 is abutted against the abutment surface 76B, so that the upstream end portion of the sheet member 60 is positioned with respect to the opposing cylinder body 52.

Further, as shown in FIGS. 8 and 9, the plate member 58 includes plural pins 57 extending toward the upstream side. As shown in FIG. 8, the pins 57 are arranged along the axial direction. The moving body 59 is attached to the plate member 58 by inserting the plural pins 57 therethrough, so that the moving body 59 is movable in the circumferential direction (that is, the thickness direction of the plate member 58) via the pins 57. Specifically, as shown in FIG. 9, the moving body 59 is movable in the circumferential direction within a range in which a flange portion 59A formed on the moving body 59 abuts against head portions 57A of the pin 57 and an end surface 59B of the moving body 59 abuts against the plate member 58. Then, compression, springs 55 attached to the pins 57 push the moving body 59 toward the upstream side. With this configuration, the second attachment member 62 attached to the moving body 59 is pushed toward the upstream side along the circumferential direction. As a result, a tensile force in the circumferential direction acts on the sheet member 60 attached to the attached member 71 and the attached member 56, In other words, the moving body 59 presses the second attachment member 62 in a direction in which tension in the circumferential direction acts on the sheet member 60.

As described above, in the present exemplary embodiment, the sheet member 60 is attached to the opposing cylinder body 52 only at both end portions thereof in the circumferential direction, with the first attachment member 61 and the second attachment member 62. Therefore, the sheet member 60 is not restrained with respect to the outer peripheral surface of the opposing cylinder body 52 except, for both end portions, in the circumferential direction, attached to the opposing cylinder body 52. In other words, the opposing cylinder 50 does not have a member that restrains a part other than both end portions of the sheet member 60 in the circumferential direction, such as an attachment portion that attaches an end portion, in the axial direction, of the sheet member 60 to the opposing cylinder body 52 along the circumferential direction.

Action According to the Present Exemplary Embodiment

Next, action according to the present exemplary embodiment will be described.

In the present exemplary embodiment, as described above, the one end portion (specifically, the downstream end portion) of the sheet member 60 in the circumferential direction is attached to the opposing cylinder body 52 with the first attachment member 61, and the other end portion (specifically, tire upstream end portion) of the street member 60 in the circumferential direction is attached to the opposing cylinder body 52 with the second attachment member 62 (see FIG. 4). Therefore, during replacement, of the sheet member 60, the sheet member 60 can be replaced fay detaching and attaching the first attachment member 61 and the second attachment member 62.

Here, consider a configuration (hereinafter, referred to as a "configuration A") in which the one end portion and the other end portion of the sheet member 60 in the circumferential direction and the one end portion and the other end portion in the width direction of the sheet member 60 are detachably attached to the opposing cylinder body 52. In the configuration A, replacement of the sheet member 60 requires detaching the one end portion and the other end portion of the sheet member 60 in the circumferential direction and the one end portion, and the other end portion in the width direction of the sheet member 60 from the opposing cylinder body 52. So, the replacement of the sheet member 60 is complicated.

In contrast, in the present exemplary embodiment, since the sheet member 60 can be replaced by detaching and attaching the first attachment member 61 and the second attachment member 62, the sheet member 60 can be replaced more easily than the sheet member 60 of the configuration A.

In the present exemplary embodiment, the through holes 61C formed in the pair of protrusions 61B of the first attachment member 61 are larger than the shaft portions of the screws 63 inserted through the through, holes 61C. Therefore, the first attachment member 61 is relatively movable in tire axial direction and the circumferential direction with respect to the screw 63 inserted through the through hole 61C.

Therefore, as compared to a configuration in which the through holes 61C have the same size as the shall, portions of the screws 63, it is easy to adjust the posture of the one end portion (specifically, the downstream end portion) of the sheet member 60 in the circumferential direction with respect to the axial direction of the opposing cylinder body 52.

In the present exemplary embodiment, the through holes 62C formed in the protrusions 62B of the second attachment member 62 are larger than the shaft portions of the screws 64 inserted through the through holes 62C. Therefore, the second attachment member 62 is relatively movable in the axial direction and the circumferential direction with respect to the screws 64 inserted through the through, holes 62C.

Therefore, as compared to a configuration in which the through holes 62C have the same size as the shaft portions of the screws 64, it is easy to adjust the posture of the other end portion (specifically, the upstream end portion), in the circumferential direction, of the sheet member 60 with respect to the axial direction of the opposing cylinder body 52.

In the present exemplary embodiment, as shown in FIG. 9, the moving body 59 presses the second attachment member 62 by the compression spring 55 in a direction in which tension in the circumferential direction acts on the sheet member 60. Therefore, as compared to a configuration in which the second attachment member 62 is directly fixed to the opposing cylinder body 52 without the attached member 56 interposed therebetween, it is prevented to loosen the sheet member 60.

In the present exemplary embodiment, the pair of protrusions 61R of the first attachment member 61 protruding from the sheet member 60 toward both sides in the axial direction are attached to the opposing cylinder body 52 via the attached member 71.

Therefore, compared to a configuration in which only a protrusion that protrudes in the circumferential direction from the one end of the sheet member 60 in the circumferential direction is attached to the opposing cylinder body 52, lifting of the sheet member 60 from the opposing cylinder body 52 at both sides, in the axial direction, of the one end portion (specifically, the downstream end portion) of the sheet member 60 in the circumferential direction is prevented.

In the present exemplary embodiment, the pair of protrusions 62B of the second attachment member 62 protruding from the sheet member 60 toward both sides in the axial direction are attached to the opposing cylinder body 52 via the attached member 56.

Therefore, as compared to a configuration in which only a protrusion that protrudes in the circumferential direction from the other end of the sheet member 60 in the circumferential direction is attached to the opposing cylinder body 52, lifting of the sheet member 60 from the opposing cylinder body 52 at both sides, in the axial direction, of the other end portion (specifically, the upstream end portion) of the sheet member 60 in the circumferential direction is prevented.

In the present exemplary embodiment, as shown in FIG. 5, the center portion 61A of the first attachment member 61 is disposed within the sheet member 60 as viewed in the thickness direction (as viewed in the radial direction) of the sheet member 60. Therefore, a region in which the sheet member 60 disposed in the opposing cylinder body 52 extends along the circumferential direction is larger than that in a configuration, (hereinafter, referred to as a "configuration B") in which the center portion 61. A of the first attachment member 61 protrudes in the circumferential direction from the one end of the sheet member 60 in the circumferential direction.

As a result, the sheet member 60 is disposed at a position, close to the leading end of the recording medium fi whose leading end portion is held by the grippers 24 and which is disposed on the outer peripheral surface of the opposing cylinder 50. As compared to the configuration B, a part of the recording medium P close to the leading end thereof is disposed on the outer peripheral surface of the sheet member 60, to thereby be maintained smooth. Therefore, as compared to the configuration 8, an ink image can be formed on the part of the recording medium P close to the leading end thereof and a margin on the leading end side of the recording medium P is reduced.

In the present exemplary embodiment, as shown, in FIGS. 6 and 7, the positioning portion 75 positions the downstream end portion, of the sheet member 60 with respect to the opposing cylinder body 52 in response to the first attachment member 61 being abutted against the upstream side of the positioning portion 75 in the circumferential direction.

Therefore, as compared, to a configuration in which the first attachment member 61 is freely movable in the circumferential direction, the downstream end portion of the sheet member 60 is prevented from being inclined with respect to the opposing cylinder body 52.

In the present exemplary embodiment, as shown in FIG. 9, the positioning portion 76 positions the upstream end portion of the sheet member 60 with respect to the opposing cylinder body 52 in response to the second attachment member 62 being abutted against the downstream side of the positioning portion 76 in the circumferential direction.

Therefore, as compared to a configuration in which the second attachment member 62 is freely movable in the circumferential direction, the upstream end portion of the sheet member 60 is prevented from being inclined with, respect to the opposing cylinder body 52.

Each of the attached member 71 to which the first attachment member 61 is attached and the attached member 56 to which the second attachment member 62 is attached are detachably attached to the opposing cylinder body 52.

Therefore, even when the attached members 71 and 56 are worn, the attached members 71 and 56 can be replaced without replacing the entire opposing cylinder body 52.

Modification of Positioning Portion 75

Figure 10:
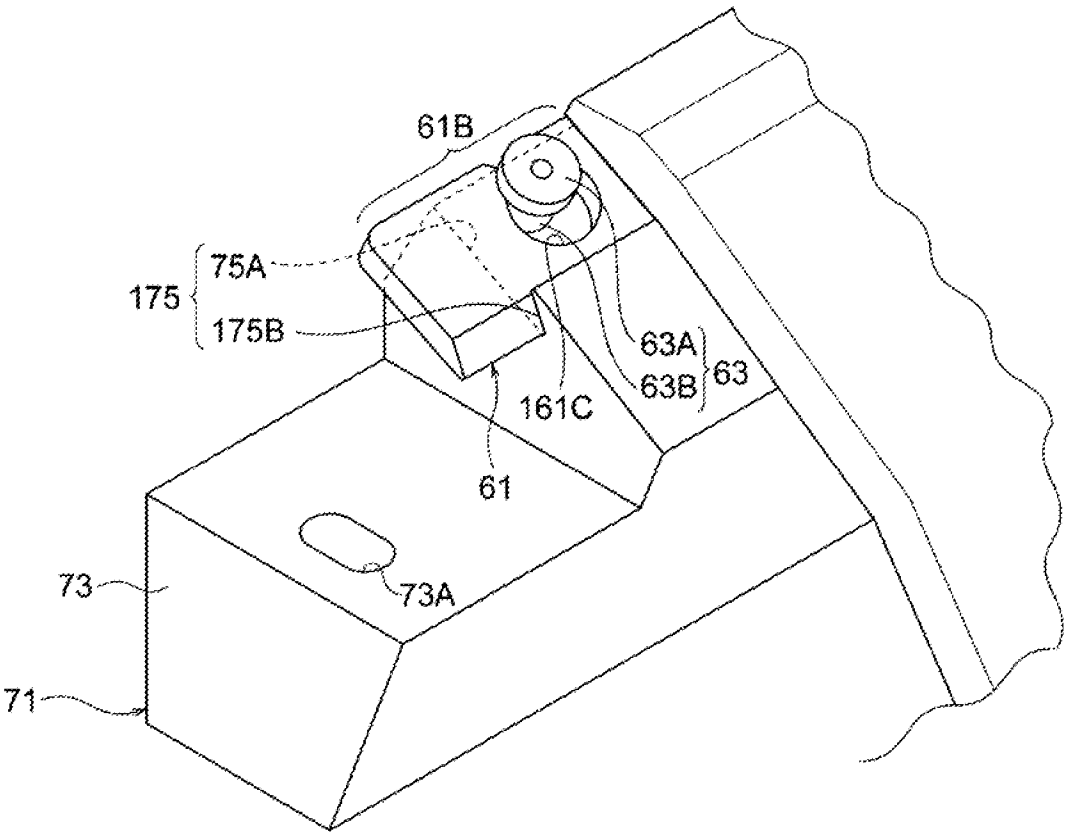
FIG. 10 is an enlarged perspective view showing a state in which one end portion, in a circumferential direction, of a sheet member according to a modification is attached.
Figure 11:
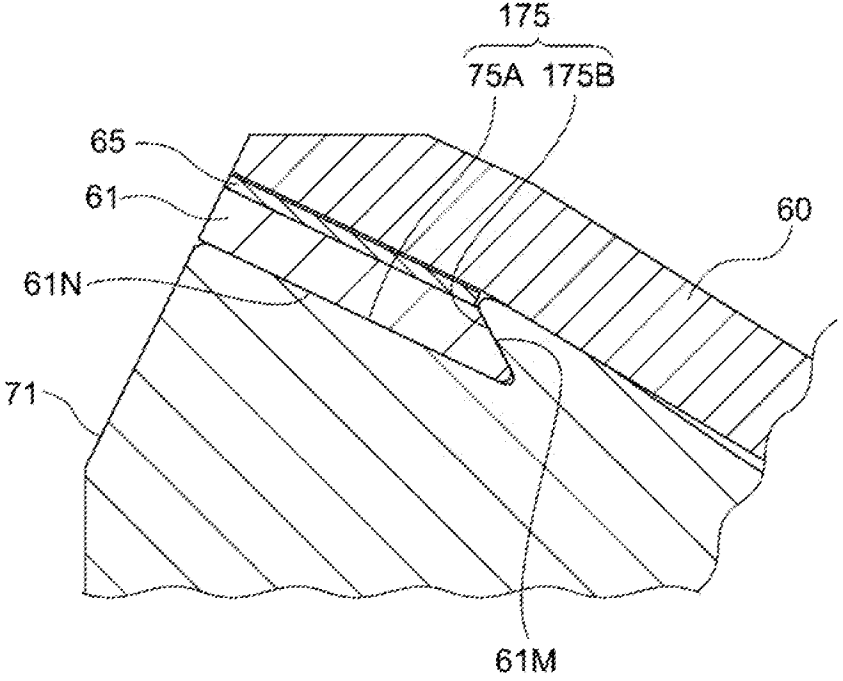
FIG. 11 is an enlarged side cross-sectional view showing the state in which the one end portion, in the circumferential direction, of the sheet member according to the modification is attached.

As an example of the positioning portion, a positioning portion 175 illustrated in FIGS. 10 and 11 may be used instead of the positioning portion 75. The positioning portion 175 includes a contact surface 75A and an abutment surface 175B. The contact surface 75A comes into contact with a radially inner surface 61N of the first attachment member 61. The abutment surface 175B abuts against a downstream end surface 61M of the first attachment member 61 in the circumferential direction.

In the present modification, the first attachment member 61 is inclined in a manner that the end surface 61M is directed outward in the radial direction. The abutment surface 175B is inclined so as to be directed inward in the radial direction. Therefore, the abutment surface 175B abuts against the end surface 61M in the circumferential direction and the radial direction.

In the modification, the inner surface 61N of the first attachment member 61 comes into contact with the contact surface 75A and the end surface 61M of the first attachment member 61 abuts against the abutment surface 175B, so that the downstream end portion of the sheet member 60 is positioned with respect to the opposing cylinder body 52.

Further, the end surface 61M abuts against the abutment surface 175B in the radial direction, so that the first attachment member 61 is restricted from moving outward in the radial direction. In this manner, in a state in which the first attachment member 61 abuts against foe abutment surface 175B, the positioning portion 175 abuts against foe first attachment member 61 in the radial, direction and restricts the first attachment member 61 from moving outward in the radial direction.

Similarly, the positioning portion 76 may be configured such that, in a state in which foe second attachment member 62 abuts against the abutment surface 76B, the positioning portion 76 abuts against the second attachment member 62 in the radial direction and restricts the second attachment member 62 from moving outward in the radial direction.

In the above manner, in the present modification, in a state in which the first attachment member 61 abuts against the abutment surface 175B, the positioning portion 175 abuts against the first attachment member 61 in the radial direction and restricts the first attachment member 61 from moving outward in the radial direction.

Therefore, as compared to a configuration in which the first attachment member 61 is freely movable outward in the radial direction of the opposing cylinder body 32, the downstream end portion of the sheet member 60 is prevented from being lifted from the opposing cylinder body 52.

Modification of Through Hole 61C

Figure 12A:
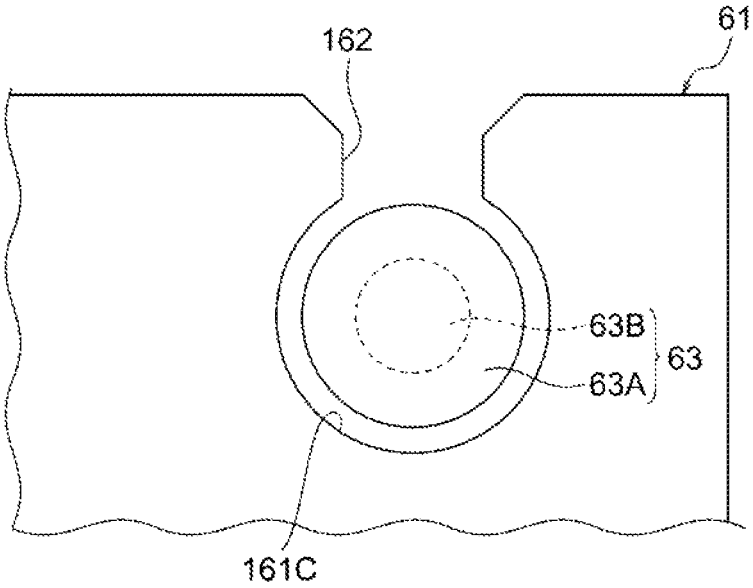
FIGS. 12A and 12B are enlarged plan, views showing a state in which a first attachment member according to the modification is attached by screwing.
Figure 12B:
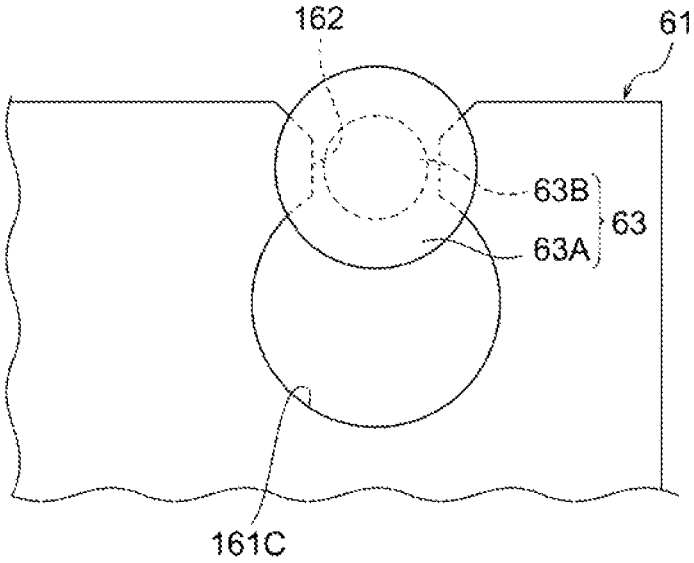

As an example of the through hole, a through hole 161C shown in FIGS. 10, 12A, and 12B may be used instead of the through hole 61C. As shown in FIG. 12A, the through hole 161C is larger than a head portion 63A of the screw 63. Further, a groove 162 connected to the through hole 161C is formed in the first attachment member 61. As shown in FIG. 12A, the groove 162 has a width larger than that of the shaft portion 63B of the screw 63 and a width smaller than that of the head portion 63A of the screw 63. The groove 162 is open to a side opposite to (specifically, the downstream side of) the through hole 61C.

Further, in a slate in which the positioning portion 175 positions the first attachment member 61 in response to the first attachment member 61 being abutted against the abutment surface 75B, the screw 63 is screwed into the attached member 71 at a position positioned in the groove 162 (see FIGS. 10 and 12B).

In the present modification, the through hole 161C is larger than the head portion 63A of the screw 63. Therefore, after the screw 63 is screwed into the attached member 71 and temporarily attached, the head portion 63A of the screw 63 may be passed through the through hole 161C to place the first attachment member 61 on the attached member 71 (see FIG. 12A). When the placed first attachment member 61 is positioned by abutting against the abutment surface 75B, the groove 162 is located at the position of the shaft portion 63B of the screw 63 (see FIG. 128). Then, the screw 63 is screwed in to attach the first attachment member 61 to the attached member 71.

In this manner, after the screw 63 is temporarily attached to the attached member 71, the first attachment member 61 is placed an the attached member 71, and attachment work of the first attachment member 61 can be performed. Thus, workability of the attachment work of the first, attachment member 61 is better than in a configuration in which the through hole 161C is smaller than the head portion 63A of the screw 63.

Other Modifications

In the present exemplary embodiment, each of the first attachment member 61 and the second attachment member 62 is attached to the respective one of the attached member 71 and the attached member 56, This configuration is a mere example and is not to be construed in any limiting sense. For example, each of the first attachment member 61 and the second attachment member 62 may be directly attached to the opposing cylinder body 52. In this case, for example, each of the first attachment member 61 and the second attachment member 62 is screwed to the opposing cylinder body 52.

In the present exemplary embodiment, the through holes 61C formed in the pair of protrusions 61B of the first attachment member 61 are larger than the shaft portions of the screws 63 inserted through the through holes 61C. This configuration is a mere example and is not to be construed in any limiting sense. For example, the through hole 61C may have the same size as the shaft portion of the screw 63.

In the present exemplary embodiment, the through holes 62C formed in the pair of protrusions 62B of the second attachment member 62 are larger than the shaft portions of the screws 64 inserted through the through holes 62C. This configuration is a mere example and is not to be construed in any limiting sense. For example, the through hole 62C may have the same size as the shaft portion of the screw 64.

In the present exemplary embodiment, as shown in FIG. 9, the moving body 59 presses the second attachment member 62 by the compression spring 55 in a direction in which tension in the circumferential direction acts on the sheet member 60. This configuration is a mere example and is not to be construed in any limiting sense. For example, the second attachment member 62 may be fixed to the opposing cylinder body 52 without the attached member 56 interposed therebetween. The moving body 59 may pull the second attachment member 62 in a direction in which tension in the circumferential direction acts on the sheet member 60 by a tension spring or the like.

In the present exemplary embodiment the pair of protrusions 61B of the first attachment member 61 projecting from the sheet member 60 toward both sides in the axial direction is attached to the opposing cylinder body 52 via the attached member 71. This configuration is a mere example and is not to be construed in any limiting sense. For example, only a protrusion that protrudes in the circumferential direction front one end of the sheet member 60 in the circumferential direction may be attached to the opposing cylinder body 52.

In the present exemplary embodiment, the pair of protrusions 628 of the second attachment member 62 projecting from the sheet member 60 toward both sides in the axial direction is attached to the opposing cylinder body 52 via the attached member 56. This configuration is a mere example and is not to be construed in any limiting sense. For example, only a protrusion, that protrudes in the circumferential direction from the other end of the sheet member 60 in the circumferential direction may be attached to the opposing cylinder body 52.

In the present exemplary embodiment, as shown in FIG. 5, the center portion 61A of the first attachment member 61 is disposed within the sheet member 60 as viewed in a thickness direction (as viewed in the radial direction) of the sheet member 60. This configuration is a mere example and is not to be construed in any limiting sense. For example, the center portion 61A of the first attachment, member 61 may protrude in the circumferential direction front the one end of the sheet member 60 in the circumferential direction.

In the present exemplary embodiment, as shown in FIGS. 6 and 7, the positioning portion 75 positions the downstream end portion of the sheet member 60 with respect to the opposing cylinder body 52 in response to the first, attachment member 61 being abutted against the upstream side of the positioning portion 75 in the circumferential direction. This configuration is a mere example and is not to be construed in any limiting sense. For example, the first attachment member 61 may be attached to the opposing cylinder body 52 so as to be movable in the circumferential direction.

In the present exemplary embodiment, as shown in FIG. 9, the positioning portion 76 positions the upstream end portion of the sheet member 60 with respect to the opposing cylinder body 52 in response to the second attachment member 62 being abetted against the downstream side of the positioning portion 76 in the circumferentiai direction. This configuration is a mere example and is not to be construed in any limiting sense. For example, the second attachment member 62 may be attached to the opposing cylinder body 52 so as to be movable in the circumferential direction.

In the present exemplary embodiment, each of the attached member 71 to which the first attachment member 61 is attached and the attached member 56 to which the second attachment member 62 is attached is detachably attached to the opposing cylinder body 52, This configuration is a mere example and Is not to be construed in any limiting sense. For example, at least one of the attached member 71 or the attached member 56 may be fixed to or integrated with the opposing cylinder body 52.

In the present exemplary embodiment, each of the first attachment member 61 and the second attachment member 62 is attached to the respective one of the attached member 71 and the attached member 56 by screwing. This configuration is a mere example and is not to be construed in any limiting sense. For example, each of the first attachment member 61 and the second attachment member 62 may be attached to the respective one of the attached member 71 and the attached member 56 by an adhesive material such, as a double-sided tape. Alternatively, each of the first attachment member 61 and the second attachment member 62 may be attached, to the respective one of the attached member 71 and the attached member 56 using an attachment structure such as a clamp and a fastener.

Second Exemplary Embodiment

Image Forming Apparatus 200

Figure 13:
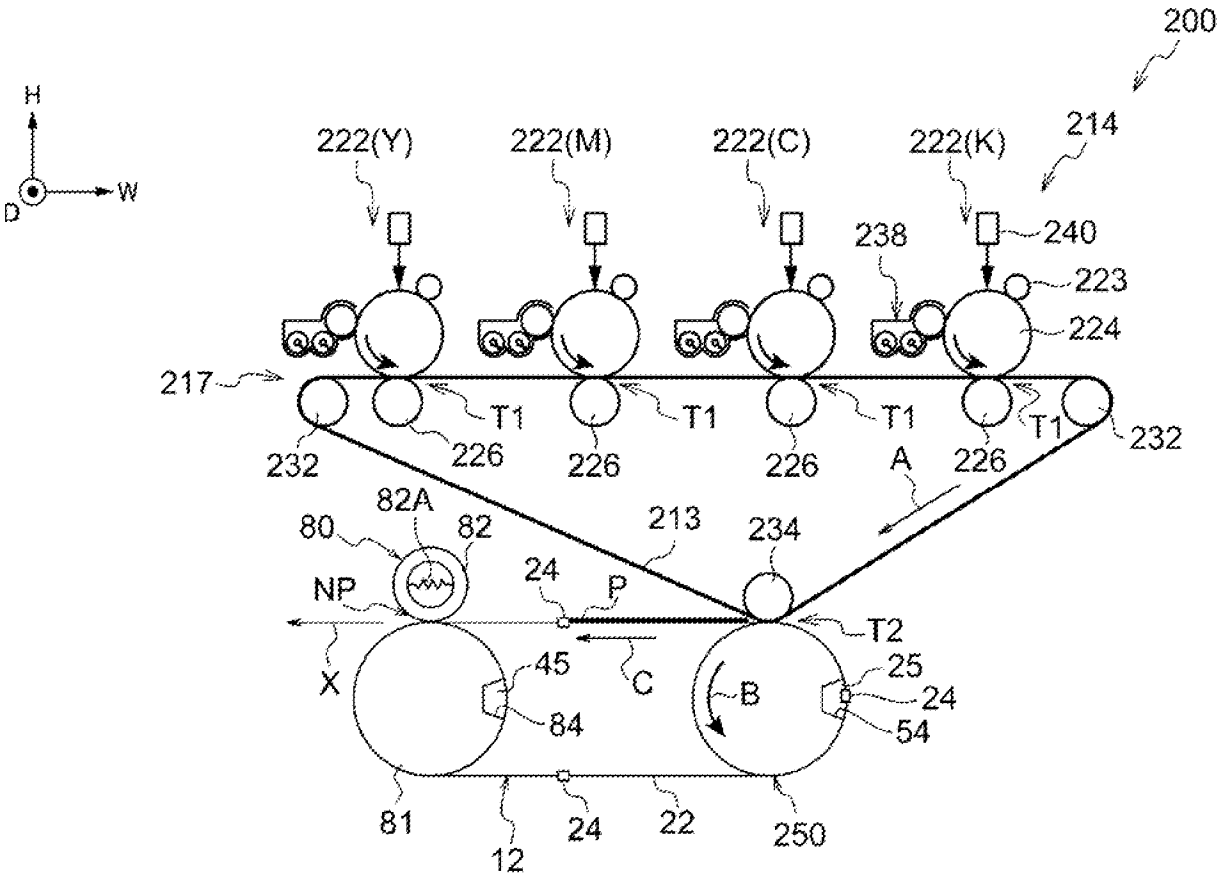
FIG. 13 is a schematic diagram showing a configuration of an image forming apparatus according to a second exemplary embodiment.

In the first exemplary embodiment, the image forming apparatus 10 is the inkjet image forming apparatus that, forms an image on the recording medium P using the ink. This configuration is a mere example and is not to be construed in any limiting sense. As an example of the image forming apparatus, for example, an electrophotographic image forming apparatus may be used or any other apparatus that forms an image may be used. In the second exemplary embodiment, an electrophotographic image forming apparatus 200 will be described. FIG. 13 is a schematic diagram showing a configuration of the image forming apparatus 200 according to the present exemplary embodiment. Farts having same functions as those in the first exemplary embodiment are denoted by the same reference numerals, and description thereof will be omitted as appropriate.

Image Forming Unit 214

The image forming apparatus 200 includes an image forming unit 214 instead of the image forming unit 14. The image forming unit 214 has a function, of forming a toner image (an example of an image) on the recording medium P using an electrophotographic technique. More specifically, as shown in FIG. 13, the image forming unit 214 includes toner image forming units 222 that form toner images, and a transfer device 217 that transfers the toner images formed by the toner image forming units 222 to the recording medium P.

Toner Image Forming Unit 222

The plural toner image forming units 222 shown in FIG. 13 are provided so as to form toner images of respective colors. In the present exemplary embodiment, the toner image forming unit 222 of four colors of yellow (Y), magenta (M), cyan (C), and black (K) are provided. (Y), (M), (C), and (K) shown in FIG. 13 show components corresponding to the respective colors described above.

Since the toner image forming units 222 of the respective colors have similar configuration except for a toner used therein, reference numerals are given to respective units of the toner image forming unit 222(K) in FIG. 13 as a representative of the toner image forming units 222 of the respective colors.

Specifically, the toner image forming unit 222 of each color includes a photoconductor 224 that rotates in one direction (for example, a counterclockwise direction in FIG. 13). The toner image forming unit 222 of each color includes a charging unit 223, an exposure device 240, and a developing device 238.

In the toner image forming unit 222 of each color, the charging unit 223 charges the photoconductor 224, Further, the exposure device 240 exposes the photoconductor 224 charged by the charging unit 223 to form an electrostatic latent image on the photoconductor 224. The developing device 238 develops the electrostatic latent image formed on the photoconductor 224 by the exposure device 240, to form a toner image.

Transfer Device 217

The transfer device 217 shown in FIG. 13 is a device that transfers the toner images formed by the toner image forming units 222 to the recording medium P. Specifically, the transfer device 217 primarily transfers the toner images of the photoconductors 224 of the respective colors onto a transfer belt 213 (as an intermediate transfer body) in a superimposed manner, and secondarily transfers the superimposed toner images onto the recording medium P. As shown in FIG. 13, the transfer device 217 includes the transfer belt 213, primary transfer rollers 226, and a transfer cylinder 250.

Each primary transfer roller 226 is a roller that transfers the toner image of the photoconductor 224 of the corresponding color to the transfer belt 213 at a primary transfer position T1 between the photoconductor 224 and the primary transfer roller 226. In the present exemplary embodiment, a primary transfer electric field is applied between the primary transfer roller 226 and the photoconductor 224, so that the toner image formed on the photoconductor 224 is transferred to the transfer belt 213 at the primary transfer position T1.

The toner images are transferred from the photoconductors 224 of the respective colors to the outer peripheral surface of the transfer belt 213. As shown, in FIG. 13, the transfer belt 213 has an endless shape. The transfer belt 213 is wound on plural rollers 232 and an opposing roller 234 so as to have an inverted triangle shape in a front view (as viewed in the apparatus depth direction). The transfer belt 213 circulates in a direction of an arrow A as at least one of the plural rollers 232 is rotationally driven.

The transfer cylinder 250 is a roller that transfers the toner image transferred to the transfer belt 213 to the recording medium P at a secondary transfer position T2 between, the opposing roller 234 and the transfer cylinder 250. In the present exemplary embodiment when a secondary transfer electric field is applied between, the opposing roller 234 and the transfer cylinder 250, the toner image transferred to the transfer belt 213 is transferred to the recording medium P at the secondary transfer position T2. The transfer cylinder 250 is configured in a similar manner as the opposing cylinder 50 of the first exemplary embodiment.

Fixing Device 80

In the present exemplary embodiment, the fixing device 80 functions as a device that fixes the toner image transferred to the recording medium P by the transfer cylinder 250 to the recording medium P. Specifically, as shown in FIG. 13, the fixing device 80 includes a pressure roller 81 and a heating roller 82.

The pair of sprockets 45 according to the first exemplary embodiment are provided on both end sides, in the axial direction, of the pressure roller 81. The pair of sprockets 45 are disposed coaxially with the pressure roller 81, and rotate integrally with the pressure roller 81. A recess 84 in which the grippers 24 and the attachment member 23 are to be accommodated is formed on the outer periphery of the pressure roller 81.

In the fixing device 80, the heating roller 82 is disposed on an upper side of the pressure roller 81. The heating roller 82 has a heating source 82A such, as a halogen lamp inside the heating roller 82.

Further, in the fixing device 80, for example, one of the pressure roller 81 and the heating roller 82 is rotationally driven, and the other of the pressure roller 81 and the heating roller 82 is rotated to follow the rotation of the one. Both the pressure roller 81 and the heating roller 82 may be rotationally driven.

The fixing device 80 fixes the toner image transferred to the recording medium P to the recording medium P by heating and pressing the recording medium P while transporting the recording medium P in a state in which the recording medium P is sandwiched between the heating roller 82 and the pressure roller 81.

In the image forming apparatus 200, as the chain 22 circulates in the circulating direction C in a state in which the grippers 24 hold a leading end portion of the recording medium P, a transport mechanism 12 causes the recording medium P to pass through the secondary transfer position T2 and a fixing position NP between the pressure roller 81 and the heating roller 82. Then, the toner images primarily transferred onto the transfer belt 213 in a superimposed manner at the primary transfer positions T1 of the respective colors are secondarily transferred onto the recording medium P at the secondary transfer position T2, The toner image secondarily transferred to the recording medium P is fixed to the recording medium P at the fixing position NP.

The transfer cylinder 250 according to the present exemplary embodiment is configured in a similar manner as the opposing cylinder 50 of the first exemplary embodiment. The present exemplary embodiment has a similar effect as that of the first exemplary embodiment.

The present disclosure is not limited to the above exemplary embodiments. Various modifications, changes, and improvements may be made without departing from the spirits of the present disclosure. For example, the modifications described above may be combined with each other as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations wifi be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cylinder member comprising:

a cylinder body having a cylindrical shape;

a sheet member wound on the cylinder body;

a first attachment portion provided at one end portion of the sheet member in a circumferential direction, the first attachment portion being detachably attached to the cylinder body; and a second attachment portion provided at the other end portion of the sheet member in the circumferential direction, the second attachment portion being detachably attached to the cylinder body; and a screw that screws the first attachment portion to (i) the cylinder body or (ii) a first attached portion attached to the cylinder body, wherein the first attachment portion has a through hole through which the screw is inserted, the through hole being larger than a shaft portion of the screw, wherein the through hole is larger than a head portion of the screw, the first attachment portion has a groove connected to the through hole, a width of the groove is larger than the shaft portion of the screw and is smaller than the head portion of the screw, and the groove has an open end on a side opposite the through hole.

2. The cylinder member according to claim 1, further comprising:

a second attached portion to which the second attachment portion is attached, the second attached portion pulling or pushing the second attachment portion in such a direction that a tension in the circumferential direction is applied to the sheet member.

3. The cylinder member according to claim 2, wherein the through hole is larger than a head portion of the screw, the first attachment portion has a groove connected to the through hole, and a width of the groove is larger than the shaft portion of the screw and is smaller than the head portion of the screw.

4. The cylinder member according to claim 3, wherein the first attachment portion comprises a pair of protrusions protruding from the sheet member toward both sides in an axial direction of the cylinder body, and the protrusions are attached to the cylinder body.

5. The cylinder member according to claim 4, wherein the first attachment portion is provided along the axial direction and on an inner peripheral surface of the one end portion of the sheet member, the first attachment portion comprises the pair of protrusions, and a center portion disposed between the protrusions, and the center portion is disposed within the sheet member when viewed in a thickness direction of the sheet member.

6. The cylinder member according to claim 2, wherein the first attachment portion comprises a pair of protrusions protruding from the sheet member toward both sides in an axial direction of the cylinder body, and the protrusions are attached to the cylinder body.

7. The cylinder member according to claim 6, wherein the first attachment portion is provided along the axial direction and on an inner peripheral surface of the one end portion of the sheet member, the first attachment portion comprises the pair of protrusions, and a center portion disposed between the protrusions, and the center portion is disposed within the sheet member when viewed in a thickness direction of the sheet member.

8. The cylinder member according to claim 1, wherein the first attachment portion comprises a pair of protrusions protruding from the sheet member toward both sides in an axial direction of the cylinder body, and the protrusions are attached to the cylinder body.

9. The cylinder member according to claim 8, wherein the first attachment portion is provided along the axial direction and on an inner peripheral surface of the one end portion of the sheet member, the first attachment portion comprises the pair of protrusions, and a center portion disposed between the protrusions, and the center portion is disposed within the sheet member when viewed in a thickness direction of the sheet member.

10. The cylinder member according to claim 1, wherein the first attachment portion comprises a pair of protrusions protruding from the sheet member toward both sides in an axial direction of the cylinder body, and the protrusions are attached to the cylinder body.

11. The cylinder member according to claim 10, wherein the first attachment portion is provided along the axial direction and on an inner peripheral surface of the one end portion of the sheet member, the first attachment portion comprises the pair of protrusions, and a center portion disposed between the protrusions, and the center portion is disposed within the sheet member when viewed in a thickness direction of the sheet member.

12. The cylinder member according to claim 1, wherein the first attachment portion comprises a pair of protrusions protruding from the sheet member toward both sides in an axial direction of the cylinder body, and the protrusions are attached to the cylinder body.

13. The cylinder member according to claim 12, wherein the first attachment portion is provided along the axial direction and on an inner peripheral surface of the one end portion of the sheet member, the first attachment portion comprises the pair of protrusions, and a center portion disposed between the protrusions, and the center portion is disposed within the sheet member when viewed in a thickness direction of the sheet member.

14. The cylinder member according to claim 1, wherein the first attachment portion is provided along an axial direction of the cylinder body and on an inner peripheral surface of the one end portion of the sheet member, and the cylinder body comprises a positioning portion against which the first attachment portion abuts in the circumferential direction so as to position the one end portion of the sheet member relative to the cylinder body.

15. The cylinder member according to claim 14, wherein in a state in which the first attachment portion abuts against the positioning portion in the circumferential direction, the positioning portion abuts against the first attachment portion in a radial direction of the cylinder body to restrict a movement of the first attachment portion to an outer side in the radial direction.

16. The cylinder member according to claim 1, further comprising:

a first attached portion detachably attached to the cylinder body, the first attachment portion being attached to the first attached portion, wherein the first attachment portion is attached to the cylinder body via the first attached portion.

17. The cylinder member according to claim 1, wherein the second attachment portion comprises protrusions protruding from the sheet member toward both sides in an axial direction of the cylinder body, and the protrusions of the second attachment portion are attached to the cylinder body.

18. An image forming apparatus comprising:

the cylinder member according to claim 1, the cylinder member being configured to transport a recording medium; and an image forming unit configured to form an image on the recording medium transported by the cylinder member.

* * * * *